US007856968B2

(12) United States Patent
Mizek et al.

(10) Patent No.: US 7,856,968 B2
(45) Date of Patent: Dec. 28, 2010

(54) MOVE-AWAY ARROW REST

(75) Inventors: Robert S. Mizek, Downers Grove, IL (US); Frank A. Harwath, Naperville, IL (US); Christopher A. Kozlik, Schaumburg, IL (US)

(73) Assignee: New Archery Products Corp., Forest Park, IL (US)

( * ) Notice: Subject to any disclaimer, the term of this patent is extended or adjusted under 35 U.S.C. 154(b) by 441 days.

(21) Appl. No.: 11/743,247

(22) Filed: May 2, 2007

(65) Prior Publication Data

US 2008/0168971 A1 Jul. 17, 2008

Related U.S. Application Data

(60) Provisional application No. 60/881,071, filed on Jan. 17, 2007.

(51) Int. Cl.
*F41B 5/22* (2006.01)

(52) U.S. Cl. ..... 124/44.5

(58) Field of Classification Search ..... 124/44.5, 124/86

See application file for complete search history.

(56) References Cited

U.S. PATENT DOCUMENTS

| | | | | |
|---|---|---|---|---|
| 2,691,974 | A | | 10/1954 | Nelson |
| 2,743,716 | A | | 5/1956 | Wendt |
| 2,777,435 | A | | 1/1957 | Brooks |
| 2,975,780 | A | | 3/1961 | Fisher |
| 3,158,145 | A | | 11/1964 | Handy |
| 3,342,173 | A | | 9/1967 | Ferguson |
| 3,757,764 | A | | 9/1973 | Ikeya |
| 3,769,956 | A | | 11/1973 | Simo |
| 3,788,299 | A | | 1/1974 | Mathews |
| 3,865,096 | A | | 2/1975 | Troncoso, Jr. |
| 3,890,951 | A | | 6/1975 | Jennings et al. |
| 4,071,014 | A | | 1/1978 | Trotter |
| 4,074,674 | A | | 2/1978 | Simo |
| 4,119,078 | A | * | 10/1978 | Wilson et al. ..... 124/44.5 |
| 4,170,980 | A | * | 10/1979 | Killian ..... 124/44.5 |
| 4,236,497 | A | | 12/1980 | Troncoso, Jr. |
| 4,278,066 | A | * | 7/1981 | Zinz, Sr. ..... 124/44.5 |
| 4,287,868 | A | | 9/1981 | Schiff |
| 4,318,390 | A | | 3/1982 | Trotter |
| 4,343,286 | A | | 8/1982 | Thacker |
| 4,407,261 | A | | 10/1983 | Elliott |

(Continued)

FOREIGN PATENT DOCUMENTS

| | | |
|---|---|---|
| EP | 0342108 | 11/1989 |

(Continued)

OTHER PUBLICATIONS

CAM-REST® Accuracy Redefined Advertisement (4 pages).

*Primary Examiner*—John Ricci
(74) *Attorney, Agent, or Firm*—Pauley Petersen & Erickson

(57) ABSTRACT

An arrow rest that moves away from a shaft, such as an arrow shaft or a bolt shaft, when the shaft is discharged from a bow, such as an archery bow or a crossbow. An actuator moves between the load position and the discharge position. During movement of the actuator, one or more arms supporting and/or guiding the shaft move away from the shaft, such as to provide clearance for the shaft and/or any corresponding vanes, fletching and/or steering devices.

15 Claims, 10 Drawing Sheets

U.S. PATENT DOCUMENTS

| | | | | | |
|---|---|---|---|---|---|
| 4,453,528 | A | | 6/1984 | Eckert | |
| 4,577,612 | A | | 3/1986 | Zell | |
| 4,579,101 | A | | 4/1986 | Bateman, III | |
| 4,632,087 | A | | 12/1986 | Cline | |
| 4,676,220 | A | | 6/1987 | Pietraszek | |
| 4,685,439 | A | | 8/1987 | Cosentino, Jr. | |
| 4,703,745 | A | | 11/1987 | Hammond | |
| 4,715,355 | A | * | 12/1987 | Lattig | 124/44.5 |
| 4,796,598 | A | | 1/1989 | Jones | |
| 4,809,670 | A | * | 3/1989 | Simo | 124/44.5 |
| 4,823,762 | A | | 4/1989 | Pugh | |
| 4,862,867 | A | | 9/1989 | Schmidt | |
| 4,865,007 | A | | 9/1989 | Saunders | |
| 4,865,008 | A | | 9/1989 | Troncoso | |
| 4,881,515 | A | | 11/1989 | Simo | |
| 4,898,145 | A | | 2/1990 | Simo | |
| 4,949,699 | A | * | 8/1990 | Gerber | 124/44.5 |
| 5,009,215 | A | | 4/1991 | Ludwig | |
| 5,025,773 | A | | 6/1991 | Hintze et al. | |
| 5,107,819 | A | | 4/1992 | Pugh | |
| 5,150,700 | A | * | 9/1992 | Troncoso | 124/44.5 |
| 5,161,514 | A | | 11/1992 | Cary | |
| 5,161,515 | A | | 11/1992 | Hammonds | |
| 5,280,777 | A | | 1/1994 | Pugh | |
| 5,341,789 | A | | 8/1994 | Paglia | |
| 5,394,858 | A | | 3/1995 | Karolian | |
| 5,413,084 | A | | 5/1995 | Haggard | |
| 5,415,154 | A | | 5/1995 | Angeloni | |
| 5,462,041 | A | | 10/1995 | Solecki | |
| 5,490,492 | A | | 2/1996 | Savage | |
| 5,503,136 | A | | 4/1996 | Tone | |
| 5,553,597 | A | | 9/1996 | Sparks | |
| 5,555,875 | A | | 9/1996 | Martin et al. | |
| 5,603,309 | A | | 2/1997 | Sheliga | |
| 5,606,961 | A | | 3/1997 | Basik et al. | |
| 5,632,263 | A | | 5/1997 | Sartain | |
| 5,676,121 | A | | 10/1997 | Bizier | |
| 5,722,381 | A | | 3/1998 | Mizek | |
| 6,021,769 | A | | 2/2000 | Troncoso | |
| 6,035,842 | A | | 3/2000 | Bradley | |
| 6,044,832 | A | | 4/2000 | Piersons, Jr. | |
| 6,082,348 | A | | 7/2000 | Savage | |
| 6,202,635 | B1 | | 3/2001 | Evans | |
| 6,595,195 | B1 | | 7/2003 | Barner et al. | |
| 6,681,753 | B2 | | 1/2004 | Afshari | |
| 6,782,881 | B2 | | 8/2004 | Mizek et al. | |
| 6,948,488 | B2 | | 9/2005 | Afshari | |

FOREIGN PATENT DOCUMENTS

| | | |
|---|---|---|
| EP | 0515213 | 11/1992 |
| WO | 01/44744 | 6/2001 |

* cited by examiner

MOVE-AWAY ARROW REST

CROSS REFERENCE TO RELATED APPLICATION

This application claims the benefit of U.S. Provisional Application No. 60/881,071, filed 17 Jan. 2007, the disclosure of which earlier application is incorporated by reference herein and made a part hereof, including but not limited to those portions which specifically appear in this application.

BACKGROUND OF THE INVENTION

1. Field of the Invention

This invention relates to an arrow rest that supports a loaded arrow shaft and then moves away from a launched arrow shaft to provide clearance for the arrow shaft and corresponding fletching, vanes or other steering devices.

2. Discussion of Related Art

Conventional arrow rests have mechanisms that allow limbs or other resting surfaces to drop away or otherwise move away from an arrow shaft, when launched from an archery bow, to provide clearance for fletching, vanes or other steering devices.

Some conventional arrow rests have pivotally mounted support elements that move away from the arrow shaft upon discharge of the arrow. Springs are used to urge the support element towards an unloaded or discharged position. Flexible inelastic members have been used to overcome the spring force that urges the support element toward the unloaded position.

Other conventional arrow rests have both lower support arms and upper support arms to maintain the arrow shaft in a loaded, ready to launch position.

Other conventional arrow rests have fall away or drop away arrow rests, some with fixed upper arms to prevent the arrow shaft from falling out of a loaded position, such as when the archery bow is tilted or moved out of a shooting position.

Other conventional arrow rests use an arrow rest arm to engage and support the arrow shaft when an archery bow is in a cocked position. A known detector assembly can detect movement of the bow away from the cocked position towards a released position, and in response can move a cam assembly that then moves the arrow rest laterally away from the arrow.

There is an apparent need for an arrow rest that can be used to hold an arrow shaft in a mounted position, even when a bow is tilted or otherwise moved, to prevent the arrow shaft from falling away from a mounted position on the arrow rest, particularly where arrow support members move away from each other and the arrow shaft during discharge or launching of the arrow.

SUMMARY OF THE INVENTION

One object of this invention is to provide an arrow rest that has arms which move away from the arrow shaft upon launching or discharge of the arrow shaft, such as away from an archery bow and/or a crossbow.

The above and other objects of this invention are accomplished with an arrow rest that moves between a load position and a discharge position. In the load position, one or more arms each supports the arrow shaft when in the load position, and also moves away from the arrow shaft when the arrow rest moves from the load position to the discharge position.

At least one arm is positioned adjacent, over or otherwise next to the arrow shaft, with or without contact, to prevent the arrow shaft from falling away from the at least one support arm, such as when an archery bow or a crossbow is tilted or otherwise moved.

In certain embodiments of this invention, an actuator can be moved in response to a detected signal and/or a mechanical or electromechanical engagement with an input source, such as a hammer or a pushrod. Upon experiencing or sensing discharge of the arrow shaft, the actuator can be moved with respect to an archery bow and/or the arrow shaft when in the at rest or load position. Many different mechanical devices and/or electromechanical devices can be used to move the actuator.

Upon actuation, the actuator can cause the arms to move away from each other, for example, to clear the discharged arrow shaft and/or the fletching, vanes or other steering device.

The particular shape, size, rigidity and materials of each arm can be designed to accommodate one or more purposes associated with holding and/or launching a shaft with respect to a bow.

In certain embodiments of this invention, each arm is normally biased into the discharge position where the arm is moved far enough away, to provide clearance for the shaft and/or the fletching, the vanes and/or another steering device. When the actuator is in the load position, in certain embodiments of this invention, the actuator interferes with one or more arms, to prevent the corresponding arm from moving into the discharge position.

The actuator can have one or more of many different designs, shapes, sizes and/or components. In some embodiments of this invention, the actuator is slidably mounted with respect to the archery bow. Each arm is connected to or integrated with a rotatable body that rotates or pivots to move each arm away from the arrow shaft.

Any suitable bias element, such as a coil spring, a leaf spring, a compression spring, a tension spring and/or any other suitable mechanical element having a bias force, can be used to normally urge one or more components of this invention into the load position and/or the discharge position. The bias elements can be sized, shaped and otherwise designed to accomplish a desired force direction and/or magnitude.

BRIEF DESCRIPTION OF THE DRAWINGS

The above and other features and objects of this invention are better understood from the following detailed description taken in view of the drawings wherein.

DETAILED DESCRIPTION OF THE INVENTION

Figure 1:
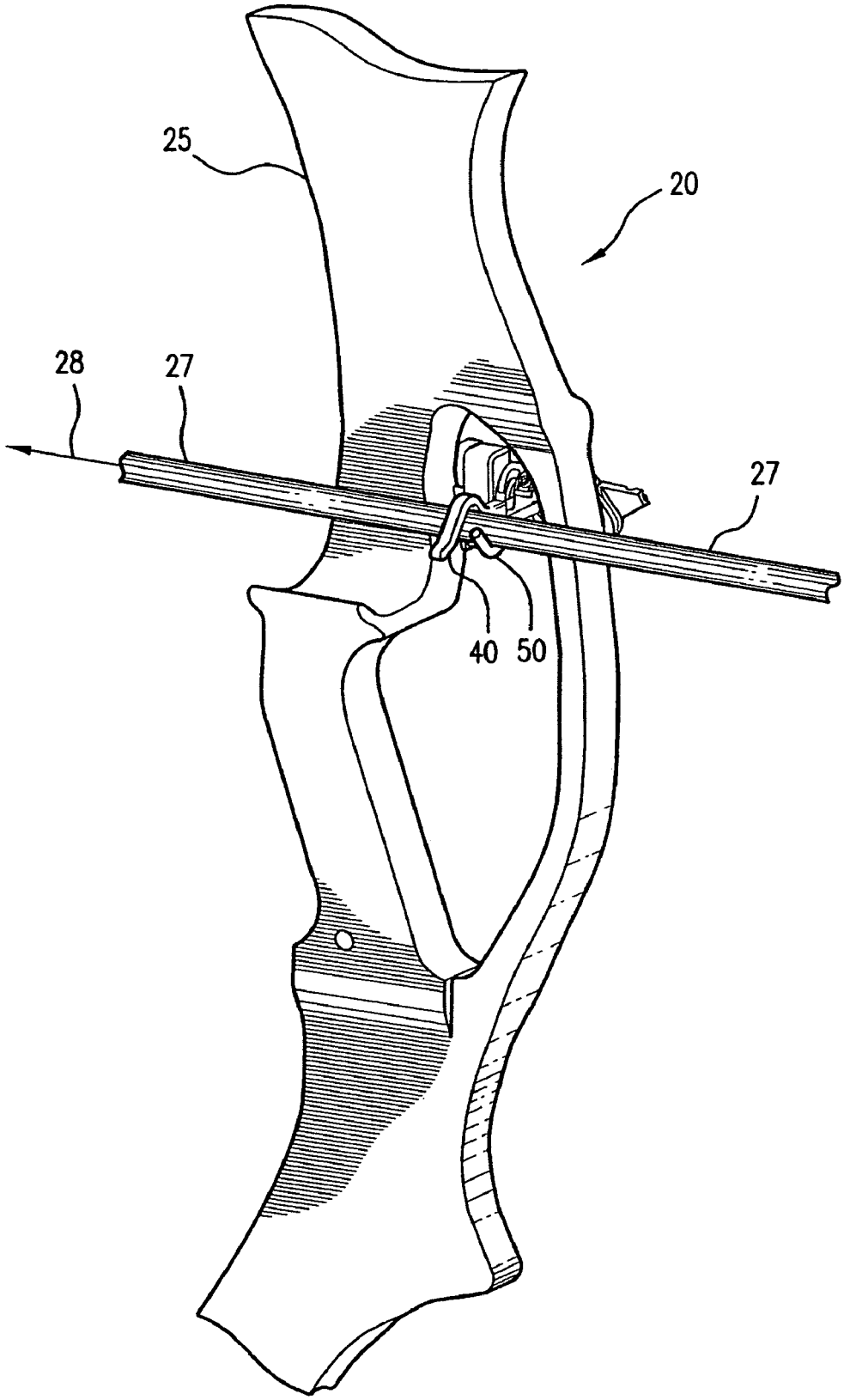
FIG. 1 is a side perspective view showing an arrow shaft mounted within an arrow rest attached to a riser portion of an archery bow, according to one embodiment of this invention.
Figure 2:
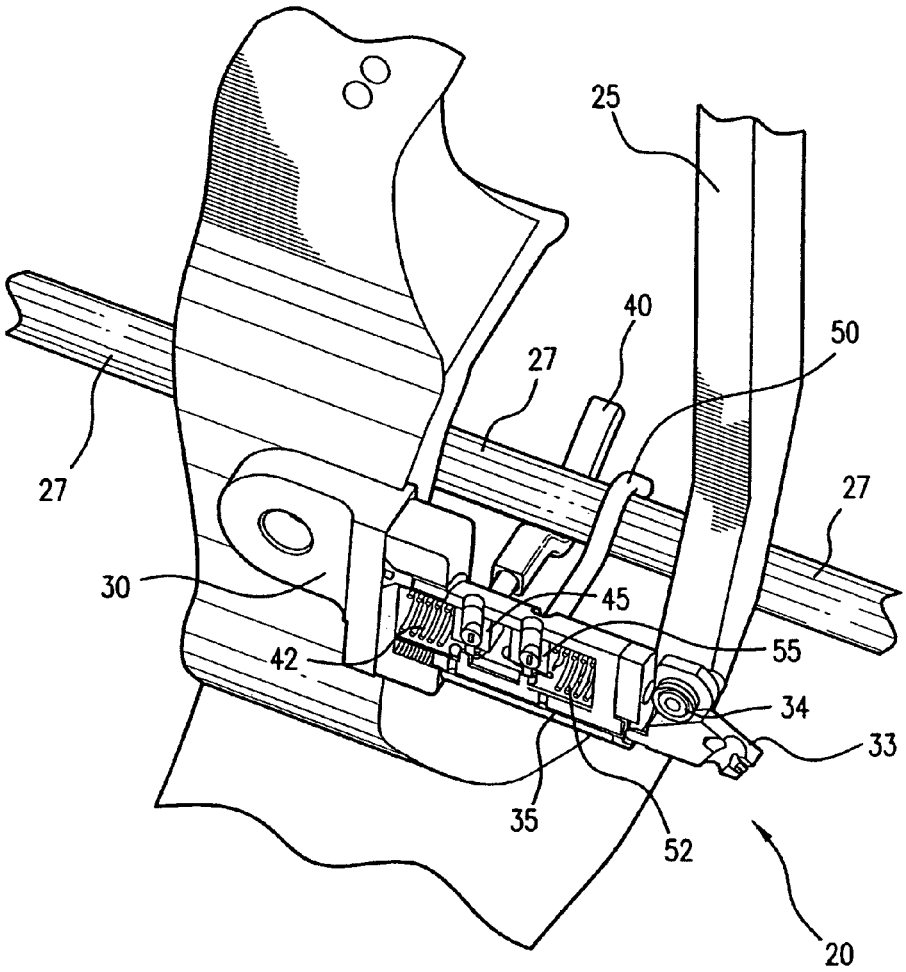
FIG. 2 is a perspective partial side view, opposite the side view shown in FIG. 1, of an arrow rest, according to one embodiment of this invention.

This invention is directed to arrow rest 20, such as shown in FIGS. 1 and 2, that moves away from shaft 27 when shaft 27 is discharged from bow 25. U.S. Pat. No. 6,782,881 describes a move-away arrow rest that operates between a loaded position and an unloaded position. Many features and elements taught by U.S. Pat. No. 6,782,881 relate to corresponding features and elements of this invention. The entire teachings of U.S. Pat. No. 6,782,881, are incorporated into this specification by reference to U.S. Pat. No. 6,782,881.

As shown in FIG. 1, shaft 27 moves from right to left when discharged in forward direction 28, as shown in FIG. 1. Although the following specification primarily discusses bow 25 as an archery bow, arrow rest 20 can be used in combination with any other archery bow, crossbow or other similar discharge device. Likewise, shaft 27 is primarily described as an arrow shaft but can comprise any other suitable archery shaft, bolt shaft such as used with a crossbow, or shaft of any other suitable projectile.

Arrow rest 20 is moveable between a load position, such as shown in FIG. 1, and a discharge position in which two or more support arms are moved away from each other. Arrow rest 20 of this invention preferably moves far enough away and fast enough to clear any fletching, vanes or other steering device connected to, attached to or otherwise associated with shaft 27.

In certain embodiments of this invention, arrow rest 20 comprises body 30 attachable to bow 25. Any threaded connection, open bore, closed bore and/or other mechanical connector can be used to removably and/or securely attach body 30 with respect to bow 25. Preferably but not necessarily, when attached, body 30 is in a fixed position with respect to bow 25.

Figure 3:
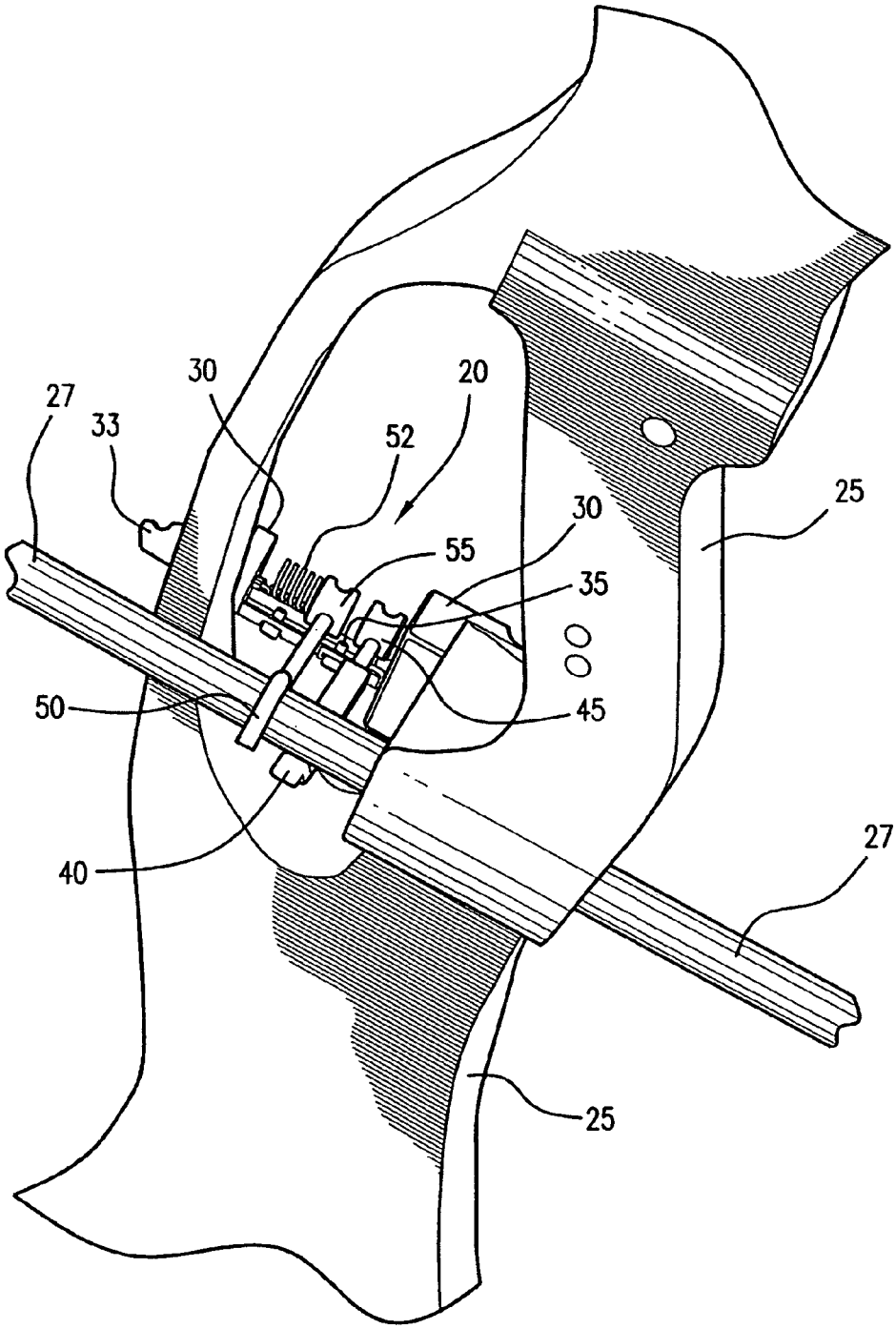
FIG. 3 is a partial perspective side view of an arrow rest, according to one embodiment of this invention.
Figure 4:
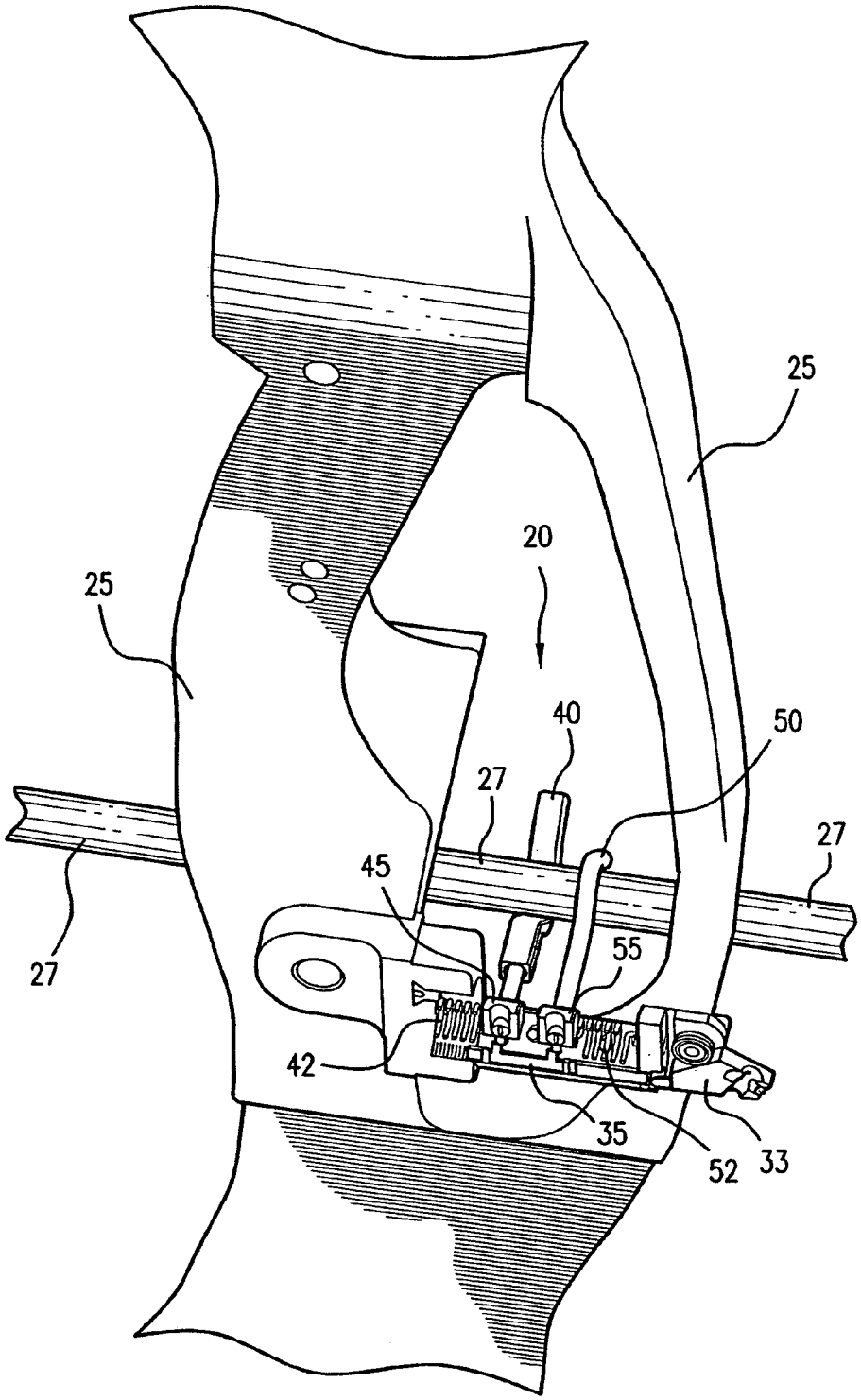
FIG. 4 is a partial perspective side view of an arrow rest, according to one embodiment of this invention.

As shown in FIGS. 2-7, 10 and 11, arrow rest 20 comprises arm 40 and arm 50 each positioned on opposite sides of shaft 27, such as shown in FIGS. 2-4. When in the load position, shaft 27 applies a downward force to and also rests upon arm 40, particularly when bow 25 is in an upright and/or use position. Arm 50 may or may not contact shaft 27 when in the load position. Arm 50 can be used to retain or otherwise hold shaft 27 in the load position, even when bow 25 is tilted or otherwise moved out of the shooting position. For example, each of arm 40 and arm 50 can be used to retain shaft 27 in a mounted position on arrow rest 20, such as when an archer is carrying bow 25 in the field.

Arm 40 and/or arm 50 each is moveably mounted with respect to body 30. As shown in FIGS. 1-7, arm 40 and/or arm 50 can pivot or rotate with respect to body 30. In other embodiments of this invention, arm 40 and/or arm 50 can otherwise be configured to mechanically move with respect to body 30. When moving from the load position to the discharge position, arm 40 preferably moves away from arm 50, for example, to provide clearance for shaft 27 and/or any associated fletching, vanes and/or other steering device.

Figure 6:
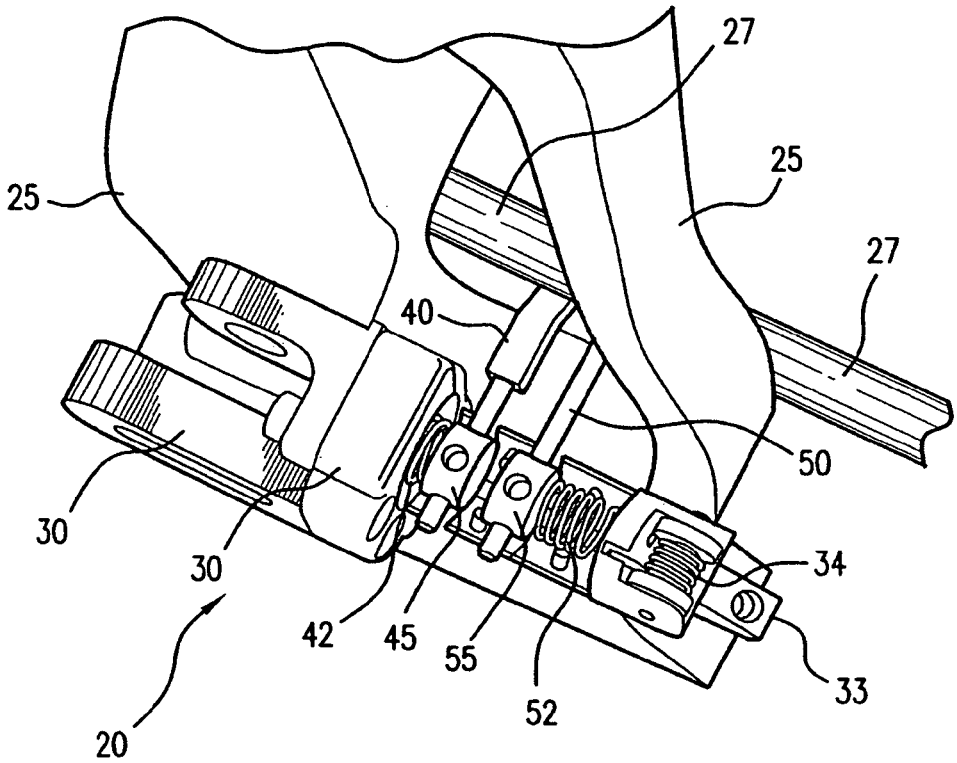
FIG. 6 is a partial perspective top view of an arrow rest, according to one embodiment of this invention.
Figure 7:
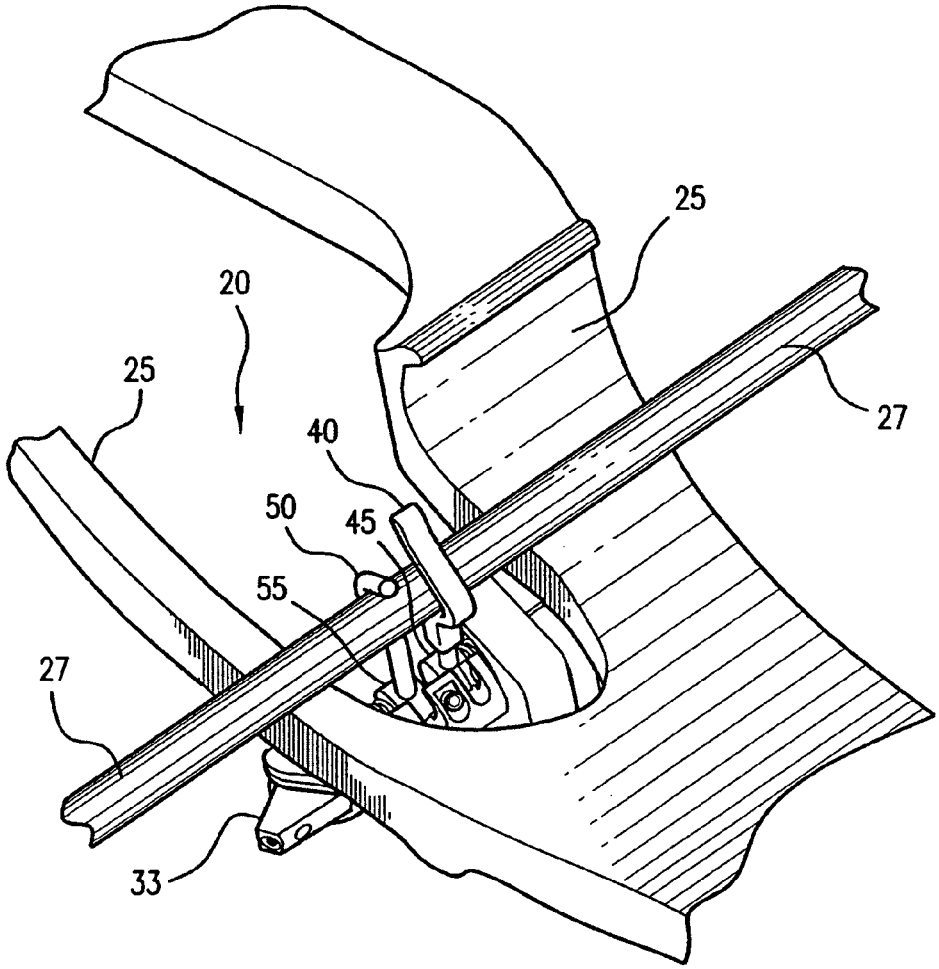
FIG. 7 is a partial perspective side view of the arrow rest, as shown in FIG. 6.
Figure 10:
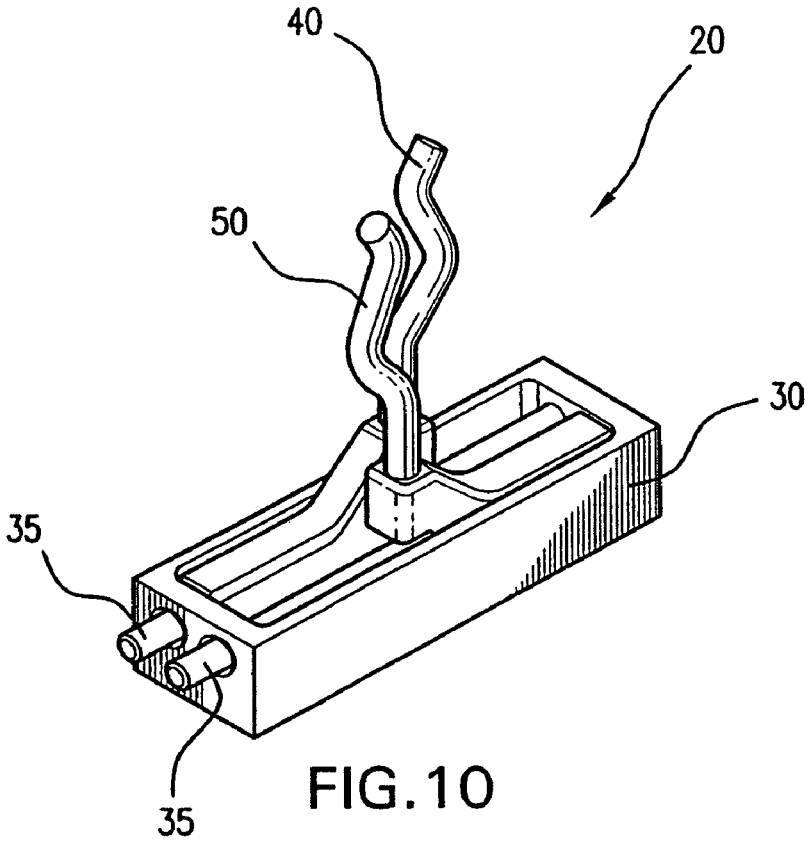
FIG. 10 is a partial perspective view of an arrow rest, according to another embodiment of this invention, in a loaded position.
Figure 11:
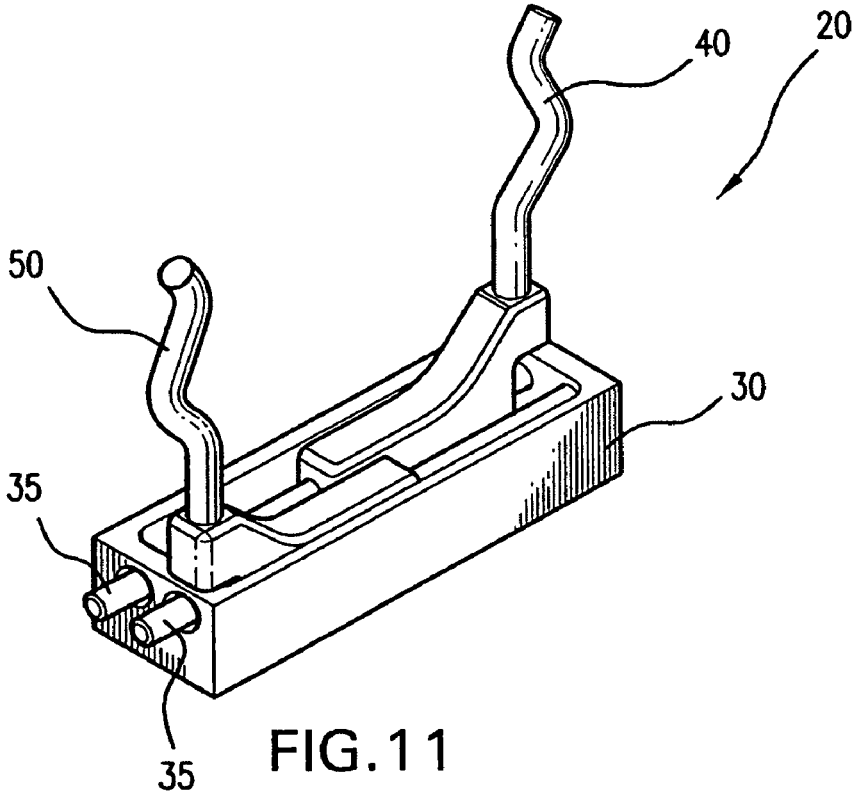
FIG. 11 is a partial perspective view of the arrow rest, as shown in FIG. 10, but in an unloaded position.

As shown in FIGS. 2 and 6, for example, bias element 42 can be used to urge arm 40 in a first radial direction, such as away from shaft 27. Likewise, bias element 52 can be used to urge arm 50 in a second radial direction which is preferably different than the first radial direction and also away from shaft 27. In other embodiments of this invention, for example as shown in FIGS. 10 and 11, arm 40 and/or arm 50 can slidably move with respect to each other and/or body 30, with or without rotational movement with respect to each other and/or body 30. If arm 40 and/or arm 50 is moveably mounted in other than a rotating or pivoting manner, such as in a sliding manner or another manner, bias element 42 and/or bias element 52 can be differently configured. For example, as shown in FIGS. 10 and 11, arm 40 and/or arm 50 can be slidably mounted with respect to body 30.

Figure 8:
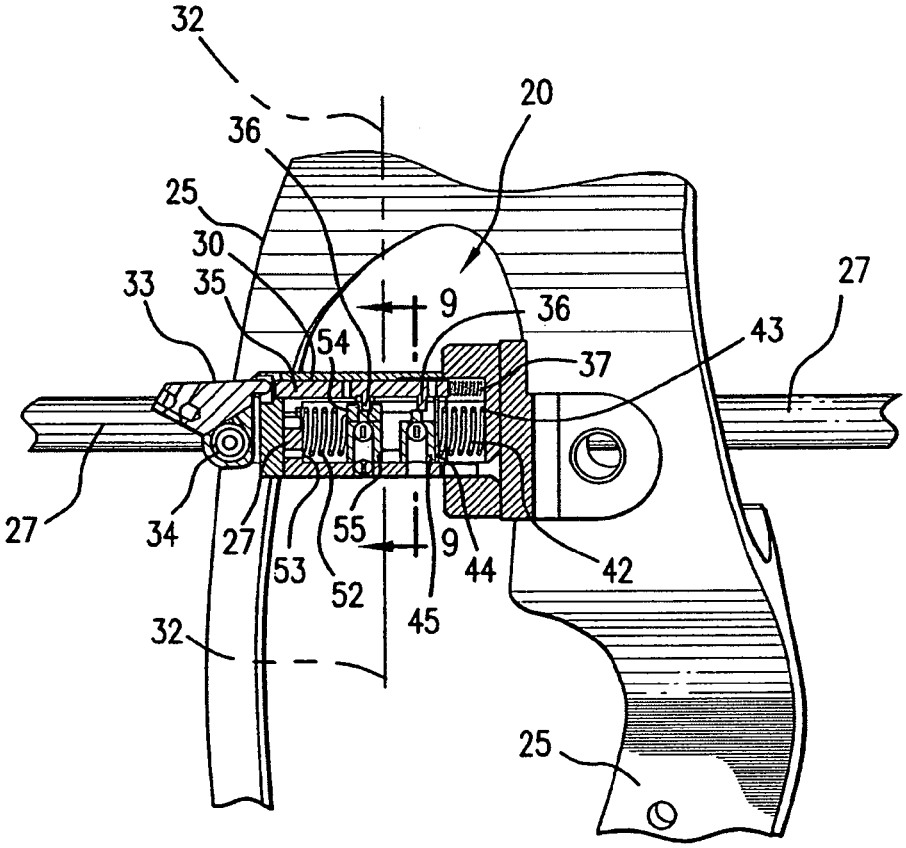
FIG. 8 is a partial cross-sectional view of some elements of an arrow rest, according to one embodiment of this invention.

In some embodiments of this invention, bias element 42 and/or bias element 52 each comprises a spring, such as a coil spring. As shown in FIG. 8, end 43 of bias element 42 can be fixed with respect to body 30 and end 44 of bias element 42 can be fixed with respect to cam element 45 and/or arm 40. Likewise, end 53 of bias element 52 can be fixed with respect to body 30 and end 54 of bias element 52 can be fixed with respect to cam element 55 and/or arm 50. With this type of a configuration, bias element 42 and/or bias element 52 can normally urge or force arm 40 and/or arm 50 into the discharge position, in which arm 40 is moved away from arm 50 and/or shaft 27 to provide any necessary clearance.

As shown by the partial cross-sectional view of arrow rest 20, in FIG. 4 for example, bias element 42 and bias element 52 and/or bias element 52 each is mounted about a pivot axis of at least one of arm 40 and arm 50. Any other suitable configuration of arm 40, arm 50, bias element 42 and/or bias element 52 can be used to accomplish the same result of moving arm 40 away from arm 50, such as when arrow rest 20 moves from the load position to the discharge position. For example, any suitable bias element 42 and/or bias element 52 can be mounted or positioned with respect to body 30, such as shown in FIGS. 10 and 11, to move arm 40 and/or arm 50.

Figure 5:
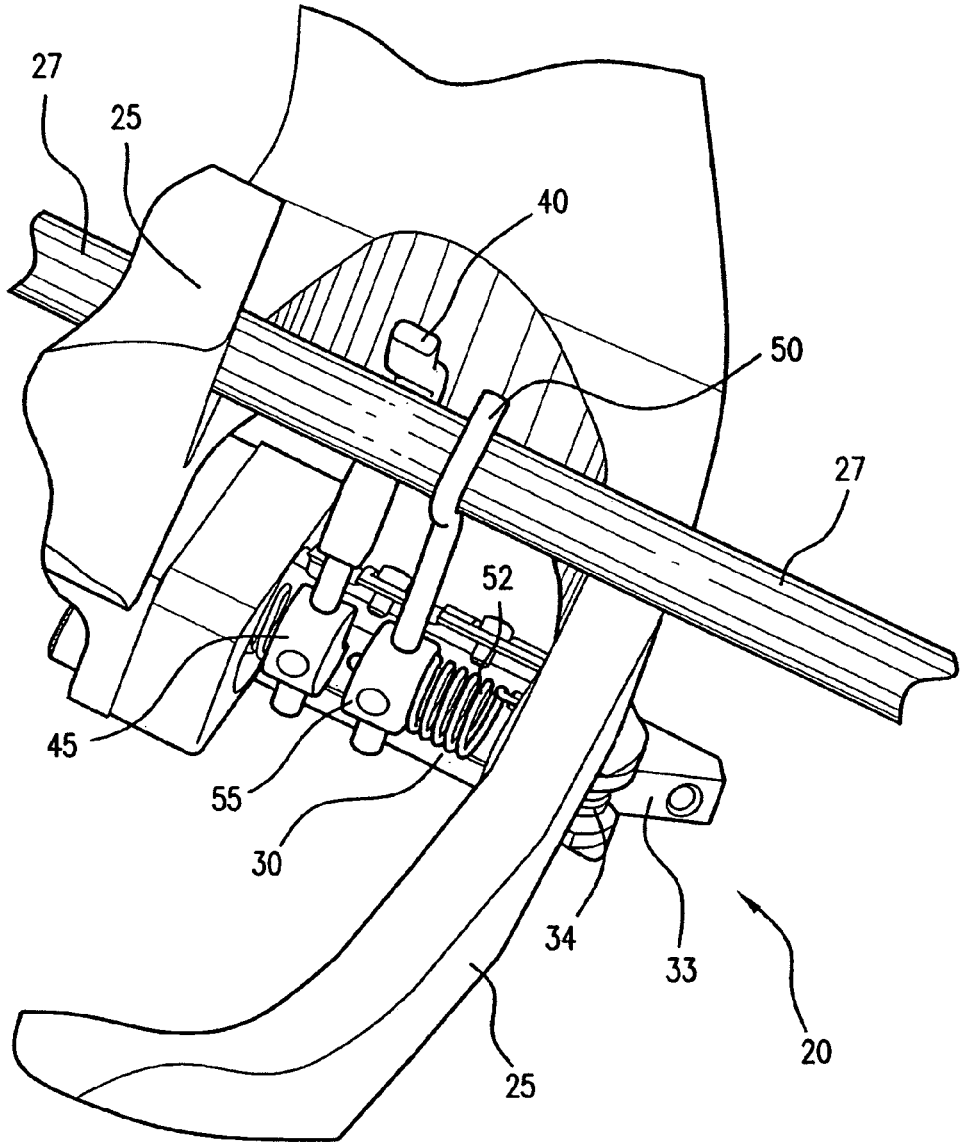
FIG. 5 is a partial perspective side view, opposite the side view shown in FIG. 4, of the arrow rest.

As shown in FIGS. 2, 8, 10 and 11, actuator 35 is moveably mounted with respect to body 30. As shown in FIG. 8, actuator 35 comprises a pin slidably mounted with respect to body 30. Actuator 35 may comprise a sear shaft, a rod and/or any other magnetic, mechanical and/or electromechanical element used to move actuator 35 with respect to body 30. In the load position, such as shown in FIGS. 8 and 10, actuator 35 maintains a position of arm 40 and/or arm 50, with respect to body 30 and with respect to each other. As shown in FIG. 8, in the load position, projections 36 of actuator 35 interfere with rotational or pivotal movement of arm 40 and/or arm 50. As shown in FIGS. 2, 5 and 8, for example, arm 40 is attached to or integrated with cam element 45. Likewise, arm 50 is attached to or integrated with cam 55. Cam element 45 and/or cam 55 can comprise a disk or any other suitably shaped body that can rotate, pivot or otherwise move with respect to body 30. As shown in FIG. 8, bias element 42 has end 44 connected directly to cam element 45, and bias element 52 has end 54 connected directly to cam 55. When actuator 35 is moved to the right, as shown in FIG. 8, projections 36 of actuator 35 move far enough to no longer interfere with cam 45 and/or cam 55. As shown in FIG. 8, when actuator 35 is moved far enough to the right, bias element 42 and bias element 52 urge arm 40 and arm 50, respectively, apart or away from each other to provide any necessary clearance.

Actuator 35 can have any suitably designed projection 36 and/or other element to release or prevent interference of actuator 35 with arm 40 and/or arm 50. For example, actuator 35 can comprise an elongated member, such as the rods shown in FIGS. 10 and 11, that slidably move with respect to body 30 when actuated or that are fixed with respect to body 30 but allow arm 40 and/or arm 50 to slide or otherwise move with respect to body 30. In other embodiments according to this invention, actuator 35 may comprise another magnetic and/or electromechanical actuating device.

As shown in FIG. 8, bias element 37 urges actuator 35 into the load position, such as where each projection 36 interferes with cam element 45 or cam element 55. In some embodiments according to this invention, bias element 37 is mounted between body 30 and actuator 35, such as shown in FIG. 8. Hammer 33 is moveably mounted with respect to body 30 and/or actuator 35. As shown in FIG. 8, hammer 33 is pivotally mounted and normally biased into a position where hammer 33 does not contact actuator 35. FIG. 8 shows bias element 34, such as a coil spring mounted to urge hammer 33 into the non-contact position shown in FIG. 8.

Any suitable force can be applied to hammer 33 or another similar mechanical element to transfer an actuation force to actuator 35. In some embodiments according to this invention, a string, cord or other member can be used to connect hammer 33 to a cable of bow 25, such as a cable for a compound archery bow. When attached to a cable of a compound archery bow, as shaft 27 moves from the load position to the discharge position, the cable, cord or other member attached between the cable and hammer 33 can be released, such as when releasing a bow string, to overcome the force of bias element 34 and thus contact actuator 35 with enough force to move actuator 35 to the discharge position, and thereby cause arm 40 to move away from arm 50. Any other suitable mechanical, magnetic and/or electromechanical device can be used to move actuator 35, arm 40 and/or arm 50.

The two lines identified with element reference numeral 32, as shown in FIG. 8, represent a plane that is positioned generally perpendicular to a longitudinal axis of shaft 27. In certain embodiments of this invention, during movement from the load position to the discharge position, at least one of arm 40 and arm 50 pivots or otherwise moves within or generally within plane 32. FIG. 8 shows arm 40 and arm 50 pivoting about the same general axis. However, arm 40 and arm 50 can pivot about different axes.

In some embodiments of this invention, bias element 34, bias element 37, bias element 42 and/or bias element 52 can be sized, designed or otherwise selected to accommodate different movements of arm 40 with respect to arm 50. Actuator 35 can be designed to move arm 40 and arm 50 simultaneously apart from each other, or apart from each other with a time delay.

One or more arms 40 and/or arms 50 can be used in addition to or in lieu of arm 40 and arm 50, as shown in FIGS. 1-8, 10 and 11.

Arm 40 and/or arm 50 can be of a rigid material and/or a flexible material. Whichever arm supports the gravity weight of shaft 27 can be relatively rigid or stiffer than the other arm, for example, to better hold or support shaft 27.

Figure 9:
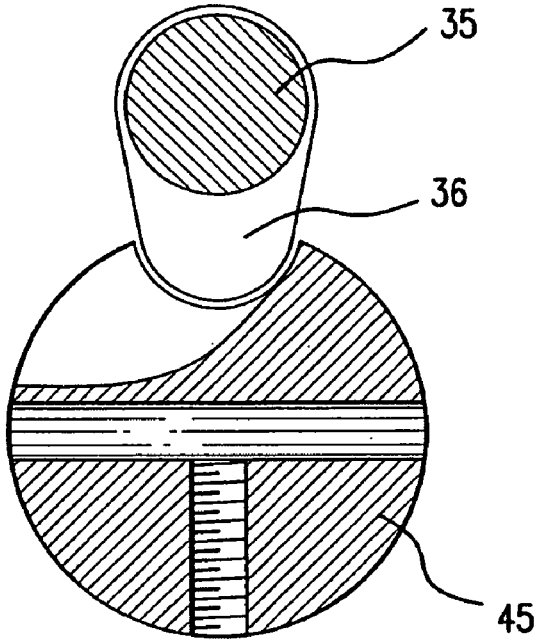
FIG. 9 is a partial sectional view taken along line 9-9, as shown in FIG. 8.

FIG. 9 shows a partial sectional view, taken along line 9-9 as shown in FIG. 8. FIG. 9 shows cam element 45 and/or cam element 55 having a generally disk shape. As cam element 45 and/or cam element 55 rotate, projection 36 moves out of a cutout area within the disk shaped structure, thereby allowing arm 40 and/or arm 50 to move in a desired direction.

The elements of this invention can be constructed of any suitable metal material, non-metal material and/or composite material. Body 30 preferably but not necessarily provides a complete enclosure for any one or more elements housed within body 30.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. An arrow rest moveable between a load position and a discharge position, the arrow rest comprising:

a body, a first arm movably mounted with respect to the body, a second arm movably mounted with respect to the body, during movement from the load position to the discharge position the first arm and the second arm moving away from each other, a first bias element urging the first arm in a first radial direction, and a second bias element urging the second arm in a second radial direction that is different than the first radial direction.

2. The arrow rest according to claim 1, wherein the body is attachable to an archery bow.

3. The arrow rest according to claim 1, wherein at least one of the first bias element and the second bias element is a spring having a first end fixed with respect to the body and a second end fixed with respect to a corresponding one of the first arm and the second arm.

4. The arrow rest according to claim 1, wherein at least one of the first bias element and the second bias element is a coil spring mounted about a pivot axis of at least one of the first arm and the second arm.

5. An arrow rest moveable between a load position and a discharge position, the arrow rest comprising:

a body, a first arm movably mounted with respect to the body, a second arm movably mounted with respect to the body, during movement from the load position to the discharge position the first arm and the second arm moving away from each other, and during movement from the load position to the discharge position at least one of the first arm and the second arm pivoting within a plane positioned generally perpendicular to an arrow shaft when in the load position.

6. The arrow rest according to claim 5, wherein at least one of the first arm and the second arm contacts an arrow shaft when in the load position.

7. An arrow rest moveable between a load position and a discharge position, the arrow rest comprising:

a body, a first arm movably mounted with respect to the body, a second arm movably mounted with respect to the body, during movement from the load position to the discharge position the first arm and the second arm moving away from each other, and at least one of the first arm and the second arm operated by a cam element.

8. The arrow rest according to claim 7, further comprising an actuator movably mounted with respect to the body, and in the load position the actuator maintaining a position of at least one of the first arm and the second arm.

9. The arrow rest according to claim 8, wherein in the discharge position the actuator releases at least one of the first arm and the second arm.

10. The arrow rest according to claim 8, wherein the actuator is slidably mounted with respect to the body, and a first bias element urges the actuator into the load position.

11. The arrow rest according to claim 10, further comprising a hammer movably mounted with respect to the body, and capable of contacting the actuator.

12. The arrow rest according to claim 11, wherein a second bias element urges the hammer away from a contact position with the actuator.

13. The arrow rest according to claim 10, wherein the first bias element is mounted between the actuator and the body.

14. The arrow rest according to claim 8, wherein in the load position the actuator interferes with movement of at least one of the first arm and the second arm.

15. An arrow rest moveable between a load position and a discharge position, the arrow rest comprising:

a body, a first arm at least one of pivotably and rotatably mounted with respect to the body, a second arm slidably mounted with respect to the body, during movement from the load position to the discharge position the first arm moving away with respect to the second arm, and an actuator operated to move at least one of the first arm and the second arm with respect to the body.

* * * * *